US007165277B2

(12) United States Patent
Taguchi et al.

(10) Patent No.: US 7,165,277 B2
(45) Date of Patent: Jan. 23, 2007

(54) ADJUSTABLE BED

(75) Inventors: Kenji Taguchi, Hirakata (JP); Masashi Morikawa, Takatsuki (JP)

(73) Assignee: Sanyo Electric Co., Ltd., Osaka (JP)

( * ) Notice: Subject to any disclaimer, the term of this patent is extended or adjusted under 35 U.S.C. 154(b) by 141 days.

(21) Appl. No.: 10/960,294

(22) Filed: Oct. 8, 2004

(65) Prior Publication Data

US 2005/0076440 A1 Apr. 14, 2005

(30) Foreign Application Priority Data

Oct. 10, 2003 (JP) ..... 2003-352281

(51) Int. Cl.
*A61G 7/015* (2006.01)

(52) U.S. Cl. ..... 5/618; 5/617

(58) Field of Classification Search ..... 5/617, 5/68, 72, 2

See application file for complete search history.

(56) References Cited

U.S. PATENT DOCUMENTS 4,376,316 A * 3/1983 Mercier et al. ..... 5/618
4,385,410 A * 5/1983 Elliott et al. ..... 5/616
5,790,997 A * 8/1998 Ruehl ..... 5/618
5,868,467 A 2/1999 Moll
5,870,784 A * 2/1999 Elliott ..... 5/618
5,906,017 A 5/1999 Ferrand et al.
6,154,899 A * 12/2000 Brooke et al. ..... 5/81.1 R
6,347,420 B1 2/2002 Elliott
6,516,480 B1 2/2003 Elliott
6,694,549 B1 * 2/2004 Perez et al. ..... 5/618

FOREIGN PATENT DOCUMENTS

JP 2000-135146 5/2000

* cited by examiner

*Primary Examiner*—Michael Trettel
(74) *Attorney, Agent, or Firm*—McDermott Will & Emery LLP

(57) ABSTRACT

An adjustable bed that enables a Gatch mechanism to be operated in an excellent fashion to match the flexing of a care recipient's body, and that is, moreover, useable as a superior low platform bed for care recipients. To this end, a parallel link mechanism having a pair of perpendicular arms is provided in the adjustable bed as part of a sitting-up mechanism, and by always keeping these arms in a perpendicular position, the sitting-up mechanism is operated with a position removed from the surface of a lower-back board by a prescribed interval as an imaginary rotation center when the bed is driven. This prevents any slippage of the care recipient's body in relation to the platform surface, thereby suppressing the occurrence of bedsores and realizing a natural sitting-up action that takes account of the care recipient's body movement.

7 Claims, 9 Drawing Sheets

ADJUSTABLE BED

BACKGROUND OF THE INVENTION

1. Field of the Invention

The present invention relates to adjustable beds used in nursing care and the like, and in particular to improving controls for changing the posture of care recipients and so forth lying on the bed.

2. Related Art

Gatch beds having so-called Gatch mechanisms for performing sitting-up and knee-break actions and so forth by flexing the platform surface of the bed longitudinally are a widely known type of adjustable bed. With a Gatch bed, as disclosed in Japanese Published Patent Application No. 2000-135146, the platform surface is partitioned into an upper-body (i.e. includes upper and lower back) platform and a lower-body (i.e. includes upper and lower legs) platform that are linked together, with the Gatch mechanism being operated by manually or mechanically raising the upper and/or lower-body platforms to a prescribed angle from a reference bed surface (generally, "horizontal bed surface").

However, with adjustable beds such as the above Gatch bed, usually the motion center of the person (e.g. care recipient) lying on the platform surface when performing a sitting-up or knee-break action does not correspond to the motion center of the bed (i.e. coupled position of the upper and lower body platforms), meaning that a displacement exists in the positional relationship between the motion centers of the bed and the care recipient's body.

If the sitting-up action, for example, is performed to raise the care recipient from a lying down position on the Gatch bed when such a displacement exists, the care recipient's back ends up slipping down relative to the surface of the upper-body platform. Shearing and frictional forces occur between the surface of the upper-body platform and the body because of the body weight at this time being placed on the upper-body platform. The shearing and frictional forces work against one another due to the care recipient's body weight, causing problems such as the following.

In the case of care recipients with motor disabilities, for example, the caregiver has to shift the care recipient to the correct position whenever the Gatch action is performed, because of the care recipient having slipped from the predetermined position on the bed surface. This places a large burden on the caregiver particularly when the sitting-up action is performed, since the caregiver is required to pull the care recipient's body back up from where it has slipped down in relation to the surface of the upper-body platform.

Moreover, with extended use of the bed, the shearing and frictional forces are exerted on the care recipient's body every time a Gatch action is performed, the accumulation of which places a burden on the body.

A similar problem also occurs when the lower-body platform is raised from the horizontal bed position to perform the knee-break action. That is, the care recipient's legs slip down in relation to the surface of the raised platform.

While such problems have led to steps currently being taken to align the Gatch bed's motion center as near as possible to that of the care recipient, the height of the platform surface in the prior art is generally raised when a bed is equipped with a Gatch mechanism, making it difficult to construct low platform beds suited to care recipients.

While Japanese Published Patent Application No. 2000-135146, for example, discloses an adjustable bed as a Gatch bed that includes, as part of a sitting-up mechanism, a parallel link mechanism (parallelogram mechanism) in which one of a pair of horizontal links is fixed to the bed frame, it is necessary, structurally, to maintain a certain length of a perpendicular arm included in the parallel link, in order to allow the sitting-up mechanism to operate in an excellent fashion to raise the upper-body platform to a large angle. However, maintaining the length of this perpendicular arm raises the platform surface by a corresponding amount, making it difficult to structure the disclosed bed as a low platform bed. Because of the difficulties in maintaining safety and operability with beds having a high platform surface, the desire is to structure Gatch beds with as low a platform surface as possible.

SUMMARY OF THE INVENTION

An object of the present invention, which was arrived at in view of the above problems, is to provide an adjustable bed that is not only usable as a low platform bed suited to care recipients, but also prevents the occurrence of bedsores and the like, and enables excellent Gatch actions to be performed that take account of the motion center of the care recipient's body.

To resolve the above problem, the present invention is an adjustable bed comprising a platform having a first surface member and a second surface member disposed adjacently in a longitudinal direction of the bed, and a Gatch mechanism for performing a Gatch action to raise a platform surface of the first surface member from a reference bed surface. Here, the Gatch mechanism includes a parallel link mechanism formed from a first arm group that lies in the longitudinal direction of the bed and a second arm group disposed at an angle intersecting the reference bed surface, with the first surface member being coupled to the second arm group by a coupling part, and as a result of the second arm group, when the Gatch action is performed, being translationally driven while maintaining the angle intersecting the reference bed surface, the Gatch mechanism raises the platform surface of the first surface member from the reference bed surface due to a circular motion of the coupling part around an imaginary rotation center located higher than the second surface member.

The present invention can also be structured so that a support arm lying in the longitudinal direction of the bed is fixed to the first arm group at a prescribed angle, and the Gatch action involves the support arm rising up together with the translational action of the second arm group, with a coupling point of the first and second arm groups as a rotation center, and pushing the first surface member up from below.

Furthermore, an adjustable bed of the present invention can also be structured to include a mechanism that is interlocked with the Gatch mechanism, and elevates the end of the second surface member nearer the first surface member to a position higher than the reference bed surface when the Gatch mechanism is driven.

Specifically, the platform can also be structured to include at least one of (a) an upper-back platform and a lower-back platform, and (b) the lower-back platform and an upper-leg platform, with a combination of the first and second surface members equating to at least one of (a) the upper-back and lower-back platforms in the same order, and (b) the upper-leg and lower-back platforms in the same order.

The platform can be structured to further include a lower-leg platform that is moveably coupled to the upper-leg platform, with the lower-leg platform inclining together with the upper-leg platform being raised from the reference bed surface when the Gatch mechanism is driven.

According to an adjustable bed of the present invention having the above structure, the second arm group is elevated upward while maintaining the intersection angle of the reference bed surface, due to the operation of the parallel link mechanism within the Gatch mechanism when the bed is driven. This causes the part coupling the first surface member to the second arm group to rise up in a circular motion around an imaginary rotation center located a prescribed distance above the surface of the second surface member. The location of the imaginary rotation center near the motion center (e.g. a predetermined joint) of the care recipient's body when flexed, allows the adjustable bed to move in sympathy with the body's motion center (i.e. motion center of sitting-up or knee-break action).

Thus, with the adjustable bed of the present invention, if the first surface member is set as the upper-back platform, slippage of the care recipient's body in relation to the surface of the upper-back platform is prevented when the sitting-up action is performed, thereby suppressing the occurrence of bedsores and realizing a natural sitting-up action (i.e. postural change from lying to sitting position) that takes account of the care recipient's body movement.

Furthermore, a major feature of the adjustable bed of the present invention is the ability to increase the angle of the first surface member with respect to the reference bed surface when the bed is driven, in proportion to the length of the support arm. That is, in order to raise the first surface member more dynamically, the support arm can be lengthened so as to increase the linear distance from the tip of the support arm to the pivotal coupling point of the first and second arm groups. Because the support arm lies in the longitudinal direction of the bed, increasing the linear distance from the tip of the support arm to the pivotal coupling point does not require the platform surface height of the adjustable bed to be increased, thereby enabling the platform surface to be kept at a low height.

Since the provision of a conventional large-scale Gatch mechanism in a lower part of the bed is not necessary to obtain an excellent Gatch action, the adjustable bed of the present invention has the merit of being usable as a so-called low platform bed having a low platform surface. The adjustable bed of the present invention is thus able to lighten the caregiver's workload, in addition to being usable as an extremely safe nursing care bed.

BRIEF DESCRIPTION OF THE DRAWINGS

These and other objects, advantages, and features of the invention will become apparent from the following description thereof taken in conjunction with the accompanying drawings, which illustrate specific embodiments of the present invention.

In the drawings.

DETAILED DESCRIPTION OF THE PREFERRED EMBODIMENTS

Embodiment 1

1-1. Overall Structure of Adjustable Bed

Figure 1:
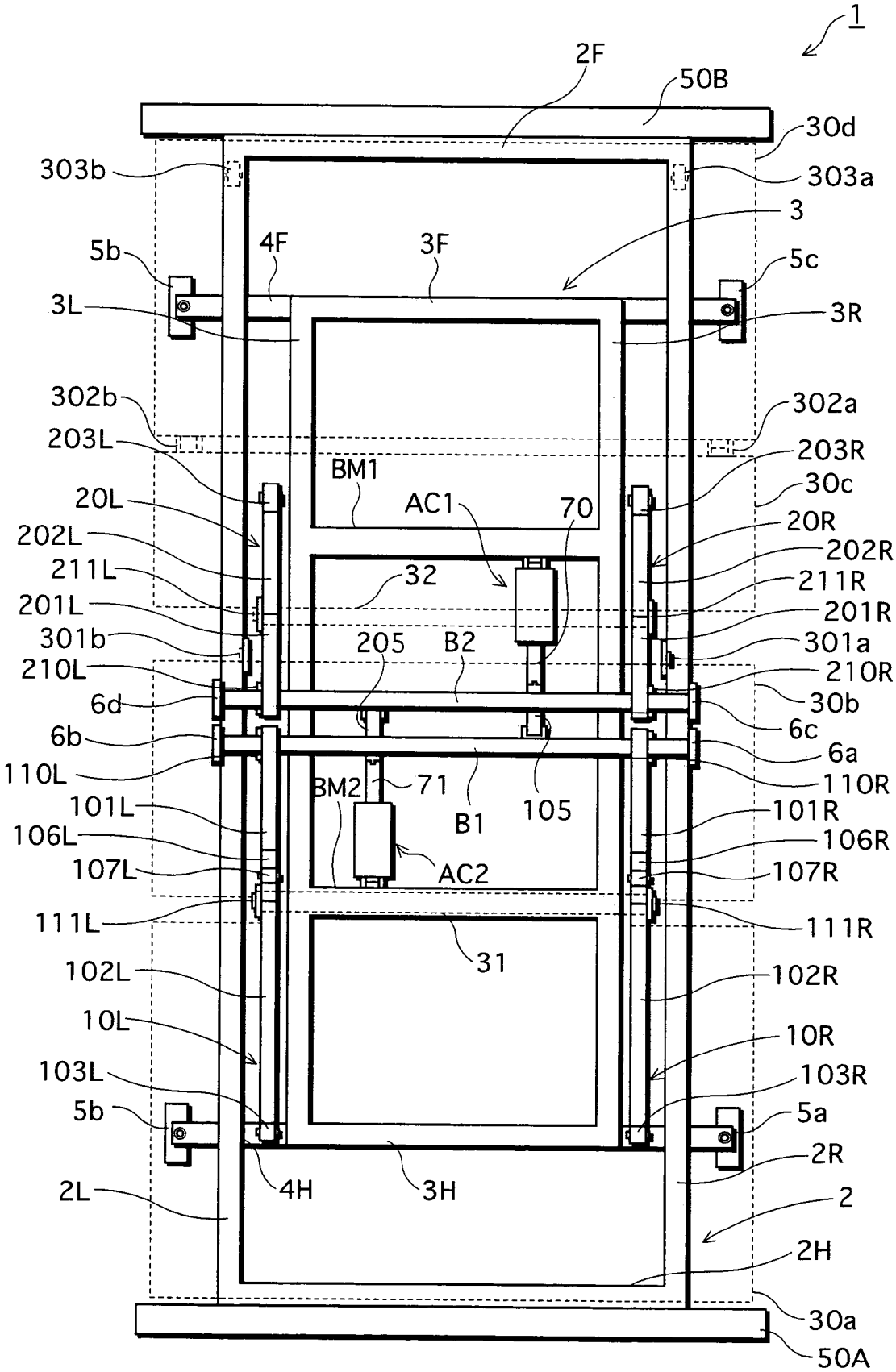
FIG. 1 is a plan view showing a structure of an adjustable bed 1 of an embodiment 1.
Figure 2:
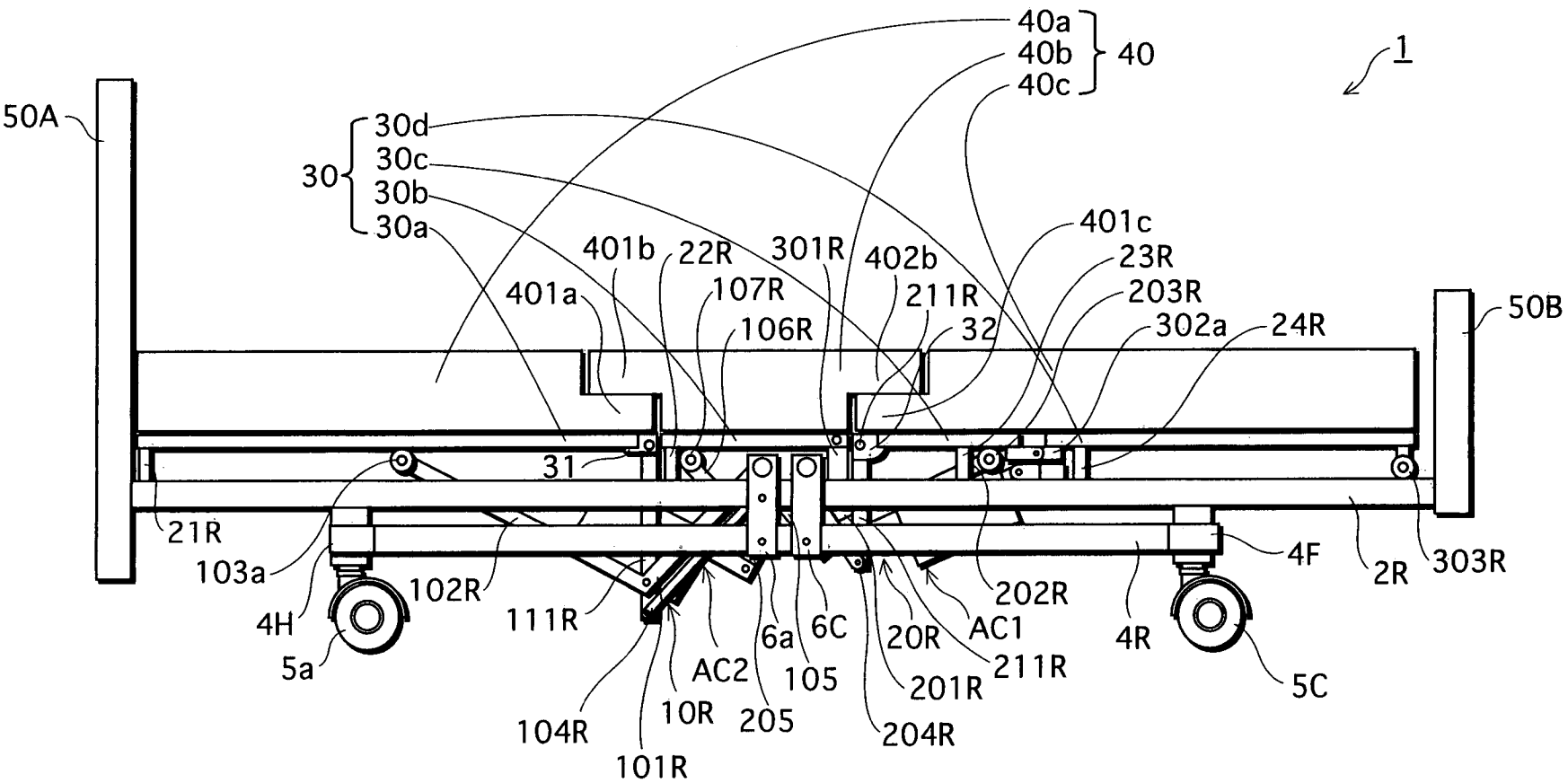
FIG. 2 is a side view of adjustable bed 1.

FIG. 1 is a plan view showing the structure of an adjustable bed 1 pertaining to embodiment 1. FIG. 2 is a side view of adjustable bed 1.

As shown in FIG. 1, adjustable bed 1 has a structure in which two rectangular frames 2 and 3 (first frame 2 and second frame 3) overlap concentrically.

First frame 2, which is larger than second frame 3, is formed from lengthwise beams 2R and 2L lying in a longitudinal direction of the bed, and cross beams 2H and 2F lying in a width direction of the bed. Boards 50A and 50B are disposed on cross beams 2H and 2F, respectively.

Second frame 3 is, similar to the first frame, formed from lengthwise beams 3R and 3L lying in the longitudinal direction, and cross beams 3H and 3F lying in the width direction. Two beams BM1 and BM2 lying parallel to cross beams 3H and 3F are disposed within the area of second frame 3, and actuators AC1 and AC2 are coupled respectively to beams BM1 and BM2 so as to intersect opposing beams in plan view.

Frames 2 and 3 are, as shown in FIG. 2, supported by a stage frame 4 of substantially the same size as second frame 3. Stage frame 4 also has lengthwise beams 4R and 4L lying in the longitudinal direction, and cross beams 4H and 4F lying in the width direction. Castors 5*a* to 5*d* are disposed one at each corner of cross beams 4H and 4F.

A coupled platform 30 forming the platform surface of adjustable bed 1 is disposed above frames 2 and 3. Coupled platform 30 is portioned into a total of four surface members; namely, an upper-back board 30*a*, a lower-back board 30*b*, an upper-leg board 30*c*, and a lower-leg board 30*d* that correspond to the body position of a person ("care recipient" in the present description) lying on the bed.

Note that with FIG. 1 the outline of coupled platform 30 is depicted with broken lines, in order to shown the internal structure of adjustable bed 1.

Upper-back board 30*a* in coupled platform 30 is fixed at a bed-foot end (i.e. as opposed to the head end of the bed or "bed-head end") thereof to sitting-up mechanisms 10R and 10L (described below) whose axis is a bar 31. Lower-back board 30*b* is axially supported by first frame 2 with fixed shafts 301*a* and 301*b* provided at a bed-foot end thereof as axes. Upper-leg board 30*c* is secured by knee-break mechanisms 20R and 20L (described below) whose axis is a bar 32. Lower-leg board 30*d* is coupled to upper-leg board 30*c* by coupling parts 302*a* and 302*b*. Coupled platform 30 is held either directly or indirectly by frames 2 and 3, thus ensuring that platform 30 does not become separated from frames 2 and 3.

Under general conditions, coupled platform 30 is, as shown in FIG. 2, supported by protrusions 21R–24R and 21L–24L provided above frame 2 (21L–24L on the far side of the bed are not depicted), and rollers 303R and 303L provided at the bed-foot end of lower-back board 30*d*, thereby keeping the platform surface parallel.

Note that as shown in FIG. 2, the platform surface formed by coupled platform 30 of adjustable bed 1 in a parallel state is referred to hereinafter as the "reference bed surface" (i.e. "horizontal bed surface" if adjustable bed 1 is disposed horizontally).

Coupled platform 30 is flexed by the driving of actuators AC1/AC2 as well as sitting-up mechanisms 10R/10L and knee-break mechanisms 20R/20L provided between first frame 2 and second frame 3, to perform sitting-up and knee-break Gatch actions.

Figure 7:
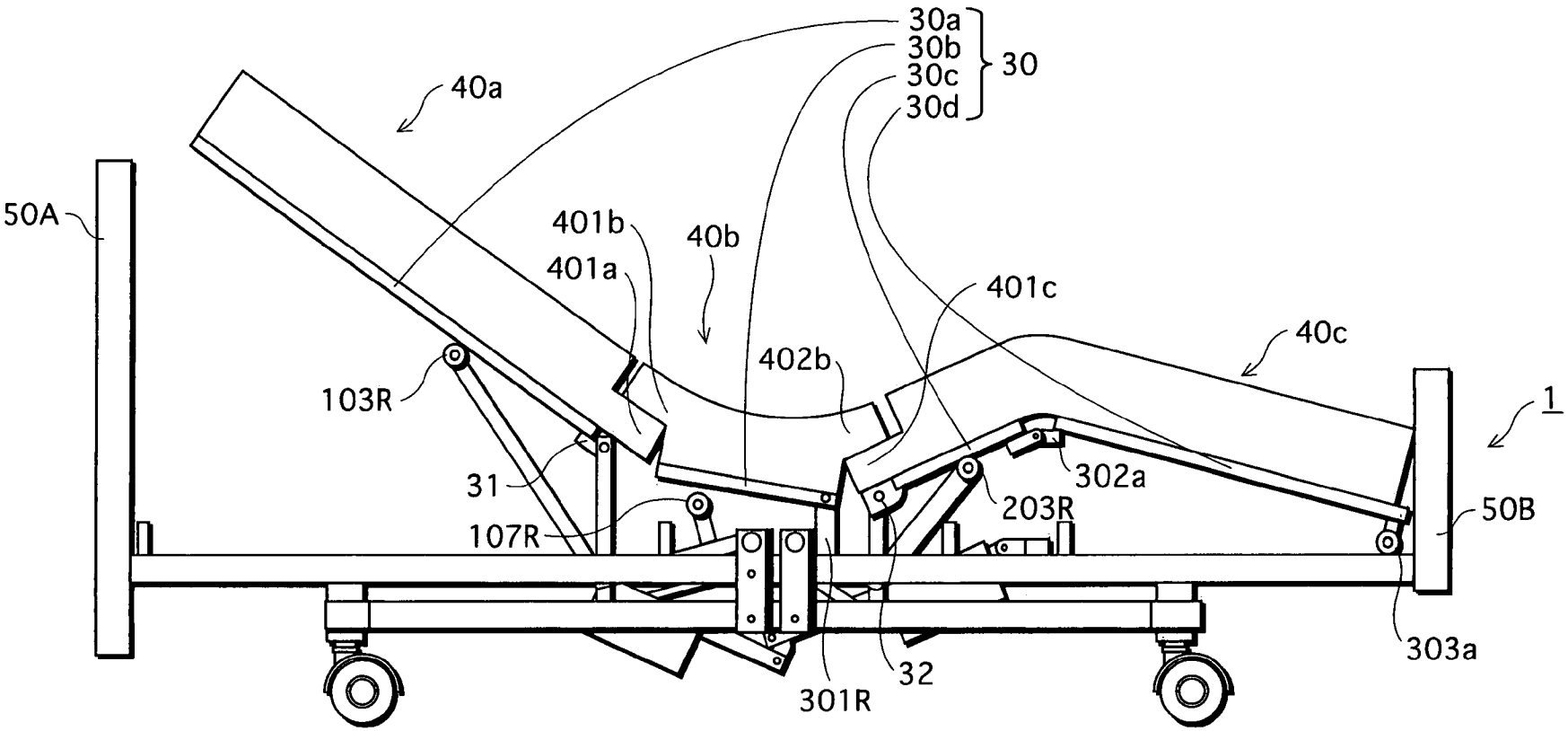
FIG. 7 shows a state of the bed when the sitting-up and knee-break mechanisms are fully extended.

Note that FIG. 2 additionally depicts the structure of an optimal mattress 40 for use with adjustable bed 1 of embodiment 1. Mattress 40 is formed from three mattress sections; namely, an upper-back mattress section 40*a*, a lower-back mattress section 40*b*, and a leg mattress section 40*c* divided in the longitudinal direction of the bed, thereby maintaining the mattress in an excellent fashion to match the Gatch action of coupled platform 30. Lower-back mattress section 40*b* preferably is fixed to lower-back board 30*b*. Mattress sections 40*a*–40*c* have protrusions 401*a*–401*c* and 402*b* that fit together in a complementary fashion in a thickness direction of the mattress. If, as shown in FIG. 7 for example, the bed is flexed as the result of a Gatch action that extends the bed in the longitudinal direction, the overall length of mattress 40 is extended due to protrusions 401*a*–401*c* and 402*b* shifting apart from one another, thereby effectively preventing coupled platform 30 from being exposed.

Note that since not all of the mattress sections are required to fit together in a complementary fashion, the above mattress may include separate mattress sections that do not overlap in the thickness direction.

1-2. Sitting-Up Mechanism

Sitting-up mechanisms 10R and 10L included in adjustable bed 1 are described here in detail.

Sitting-up mechanisms 10R and 10L are, as shown in FIG. 1, provided so as fit respectively into the space between first frame 2 and second frame 3 on the left and right sides in the width direction of the bed.

Figure 3:
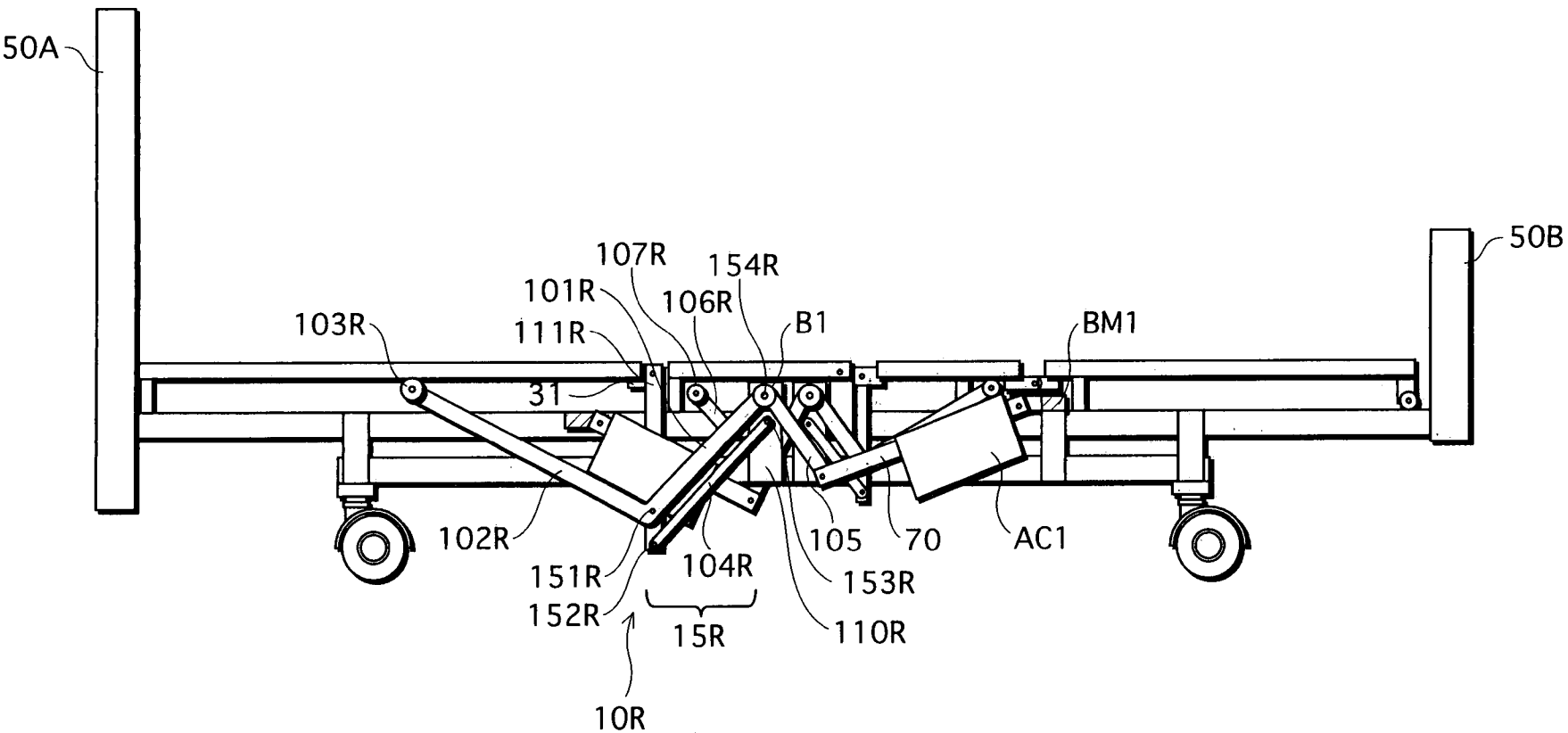
FIG. 3 schematically shows a structure of a sitting-up Gatch mechanism.

FIG. 3 schematically shows the structure of sitting-up mechanism 10R.

As shown in FIG. 3, sitting-up mechanism 10R is constituted from a parallel link mechanism 15R, actuator AC1, a bar B1, a drive arm 105, a support arm 102R, and the like.

Parallel link mechanism 15R is formed from a pair of perpendicular arms 110R/111R, and a pair of moving arms 101R/104R. Perpendicular arm 110R is moveably coupled to moving arms 101R and 104R by pivotal coupling points 154R and 153R, while perpendicular arm 111R is moveably coupled to moving arms 101R and 104R by pivotal coupling points 151R and 152R. The top end of perpendicular arm 111R is rotationally supported by bar 31 of upper-back board 30*a*.

Perpendicular arm 110R is fixed to frames 2 and 4. In contrast, perpendicular arm 111R is freely movable, not being fixed to frames 2 and 4. Here, a feature of embodiment 1 is the fact the pair of perpendicular arms 110R and 111R are always kept parallel in a perpendicular position, as a result of perpendicular arm 110R being fixed to frames 2 and 4.

Pivotal coupling point 154R in perpendicular arm 110R axially supports bar B1, whose axis is pivotal coupling point 154R. Both ends of bar B1 are firmly secured by plates 6*a* and 6*b* as shown in FIGS. 1 and 2, while moving arm 101R and drive arm 105 coupled to the tip of shaft 70 in actuator AC1 are fixed at a prescribed angle to the circumferential surface of bar B1. The driving force of actuator AC1 is thus conveyed via drive arm 105 and bar B1 to parallel link mechanism 15R, which rotates around pivotal coupling point 154R (i.e. rotation center of parallel link).

On the other hand, pivotal coupling point 151R in perpendicular arm 111R axially supports moving arm 101R and support arm 102R, which are fixed together at a prescribed angle. Support arm 102R lies in the longitudinal direction, and has a roller 103R provided at the tip thereof. Generally, roller 103R supports upper-back board 30*a* in a horizontal position, with the angle between moving arm 101R and support arm 102R being set so that roller 103R is tucked underneath upper-back board 30*a* (in the FIGS. 2 and 3 examples, roller 103R contacts with the underside of upper-back board 30*a*).

On moving arm 101R is disposed a lifting arm 106R that faces toward coupled platform 30. Lifting arm 106R has a roller 107R provided at a tip thereof, and operates as part of the sitting-up mechanism to push lower-back board 30*b* up from below and keep lower-back board 30*b* at a prescribed angle with respect to the reference bed surface.

Figure 5:
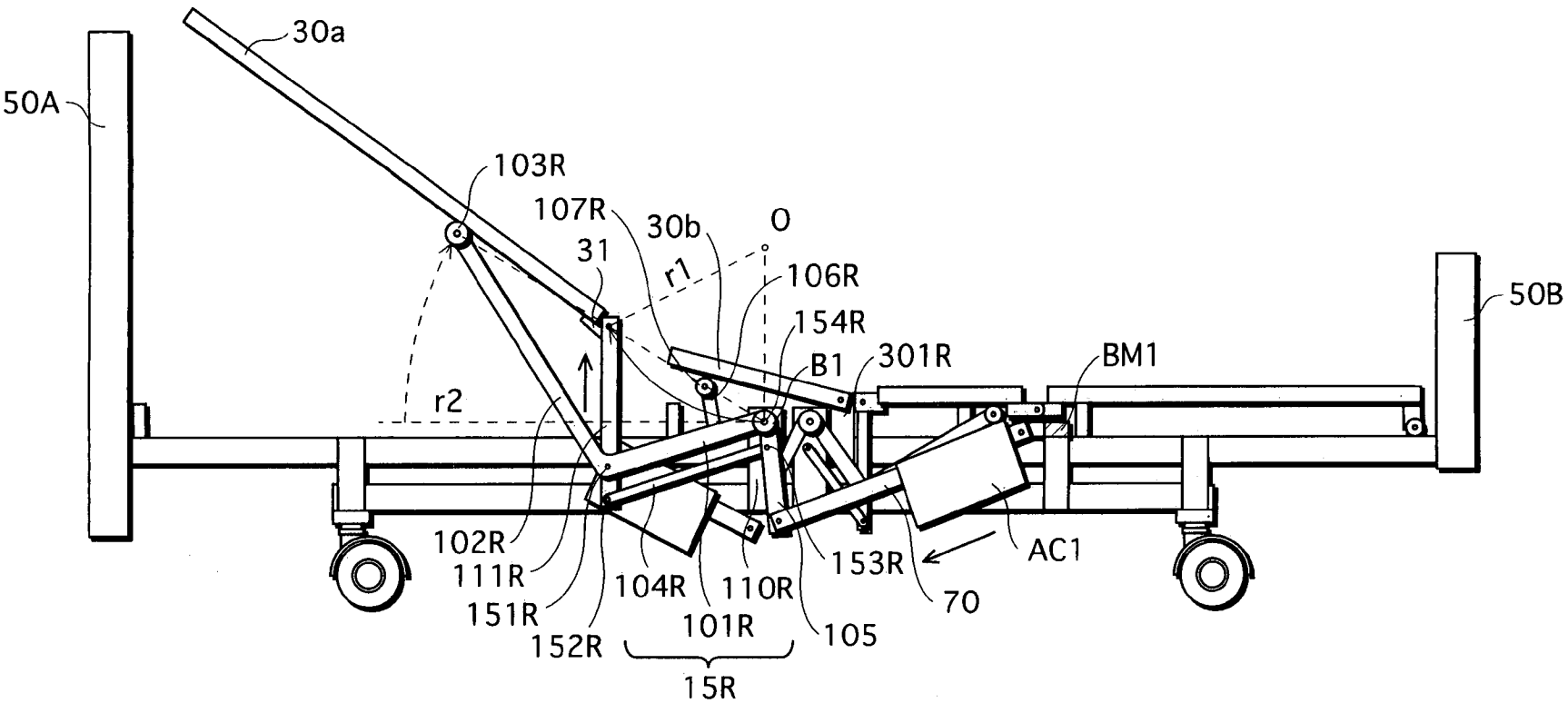
FIG. 5 schematically shows a state when the sitting-up mechanism is operated.

Providing parallel link mechanism 15R having the pair of perpendicular arms 110R/111R and always keeping arms 110R/111R in a perpendicular position allows sitting-up mechanism 10R to perform the sitting-up action around an imaginary rotation center O located a prescribed distance from the surface of lower-back board 30*b*, based on the translational driving of parallel link mechanism 15R when the bed is driven (see FIG. 5). Imaginary rotation center O is provided so as to be near the motion center of the care recipient's body when the sitting-up action is performed.

The effects of the sitting-up mechanism are described in a later section.

Note that the structure of sitting-up mechanism 10L is similar to sitting-up mechanism 10R.

Because sitting-up mechanisms 10R and 10L, as shown in FIG. 1, share bar B1, actuator AC1 and drive arm 105, mechanisms 10R and 10L are driven simultaneously in the same manner when the action is performed.

Note that the actions of actuators AC1 and AC2 may be controlled, for example, by any of a range of motor drivers and microcomputers available on the market, and that drive settings (e.g. manual/automatic, program settings) can be carried out by the care recipient or caregiver via a remote controller connected to the microcomputer.

1-3. Knee-Break Mechanism

Knee-break mechanisms 20R and 20L included in adjustable bed 1 are described here in detail.

Knee-break mechanisms 20R and 20L are, as shown in FIG. 1, provided in the space between first frame 2 and second frame 3 on the left and right sides of the bed in the width direction. Knee-break mechanisms 20R and 20L approximately resemble sitting-up mechanisms 10R and 10L described above.

Figure 4:
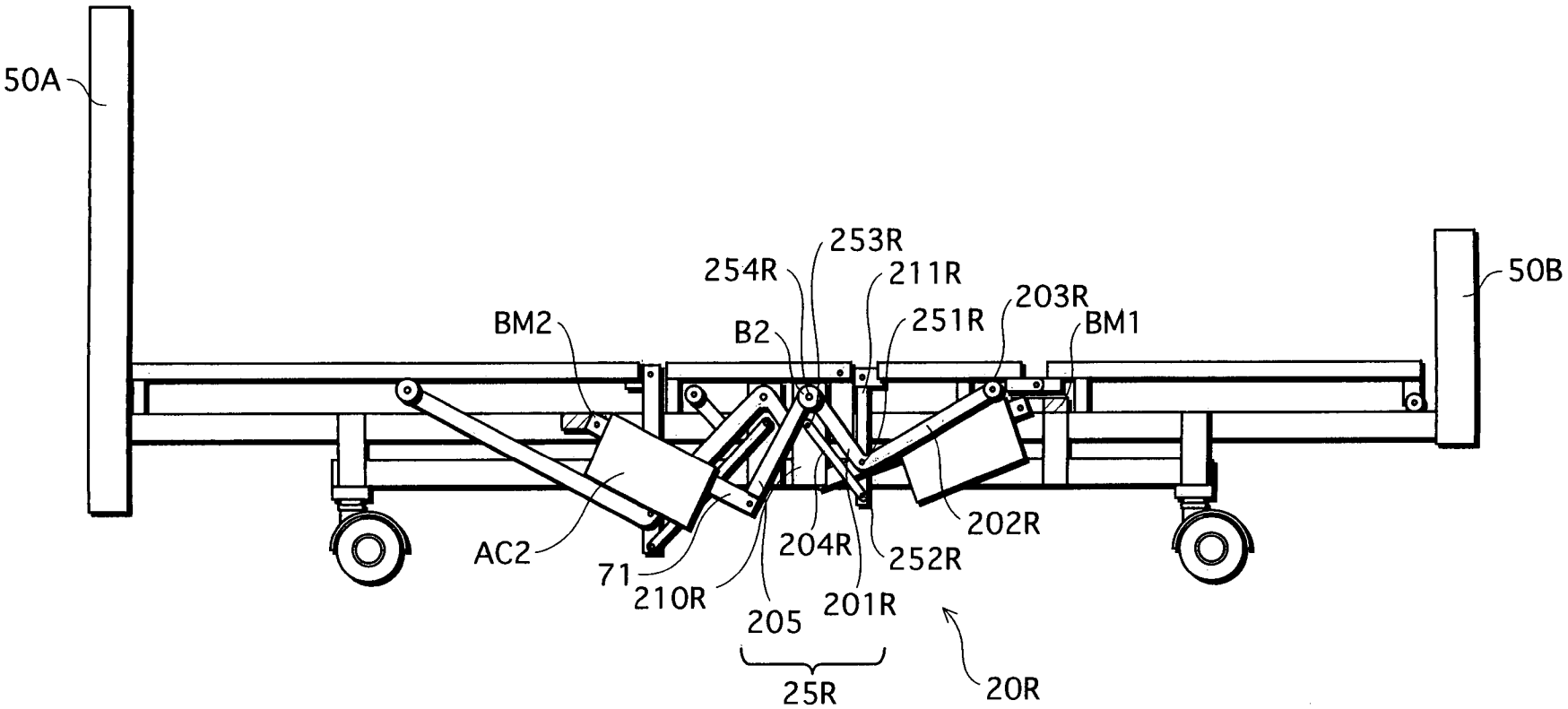
FIG. 4 schematically shows a structure of a knee-break Gatch mechanism.

FIG. 4 schematically shows the structure of knee-break mechanism 20R.

As shown in FIG. 4, knee-break mechanism 20R is constituted from a parallel link mechanism 25R, actuator AC2, a bar B2, a drive arm 205, a support arm 202R, and the like.

Parallel link mechanism 25R is formed from a pair of perpendicular arms 210R and 211R, and a pair of moving arms 201R and 204R. Perpendicular arm 210R is moveably coupled to moving arms 201R and 204R by pivotal coupling points 254R and 253R, while perpendicular arm 211R is moveably coupled to moving arms 201R and 204R by pivotal coupling points 251R and 252R. Perpendicular arm 210R is fixed to frames 2 and 4. In contrast, perpendicular arm 211R is freely movable, not being fixed to frames 2 and 4. Here, a feature of embodiment 1 is the fact the pair of perpendicular arms 210R and 211R are always kept parallel in a perpendicular position, as a result of perpendicular arm 210R being fixed to frames 2 and 4. The top end of perpendicular arm 211R is rotationally supported by bar 32 attached to upper-leg board 30*c*.

Bar B2 is provided at pivotal coupling point 254R, which also forms the axis of bar B2. Both ends of bar B2 are firmly secured by plates 6*c* and 6*d* as shown in FIGS. 1 and 2, while moving arm 201R and drive arm 205 coupled to the tip of shaft 71 in actuator AC2 are fixed at a prescribed angle to bar B2. The driving force of actuator AC2 is thus conveyed via drive arm 205 and bar B2 to parallel link mechanism 25R, which rotates around pivotal coupling point 254R (i.e. rotation center of parallel link).

On the other hand, moving arm 201R and support arm 202R are fixed together at a prescribed angle at pivotal coupling point 251R. Support arm 202R lies in the longitudinal direction, and has a roller 203R provided at the tip thereof. Generally, roller 203R keeps upper-leg board 30*c* in a horizontal position, with the angle between moving arm 201R and support arm 202R being set so that roller 203R is tucked underneath upper-leg board 30*c* (in the FIGS. 2 and 4 examples, roller 203R contacts with the underside of upper-leg board 30*c*).

Figure 6:
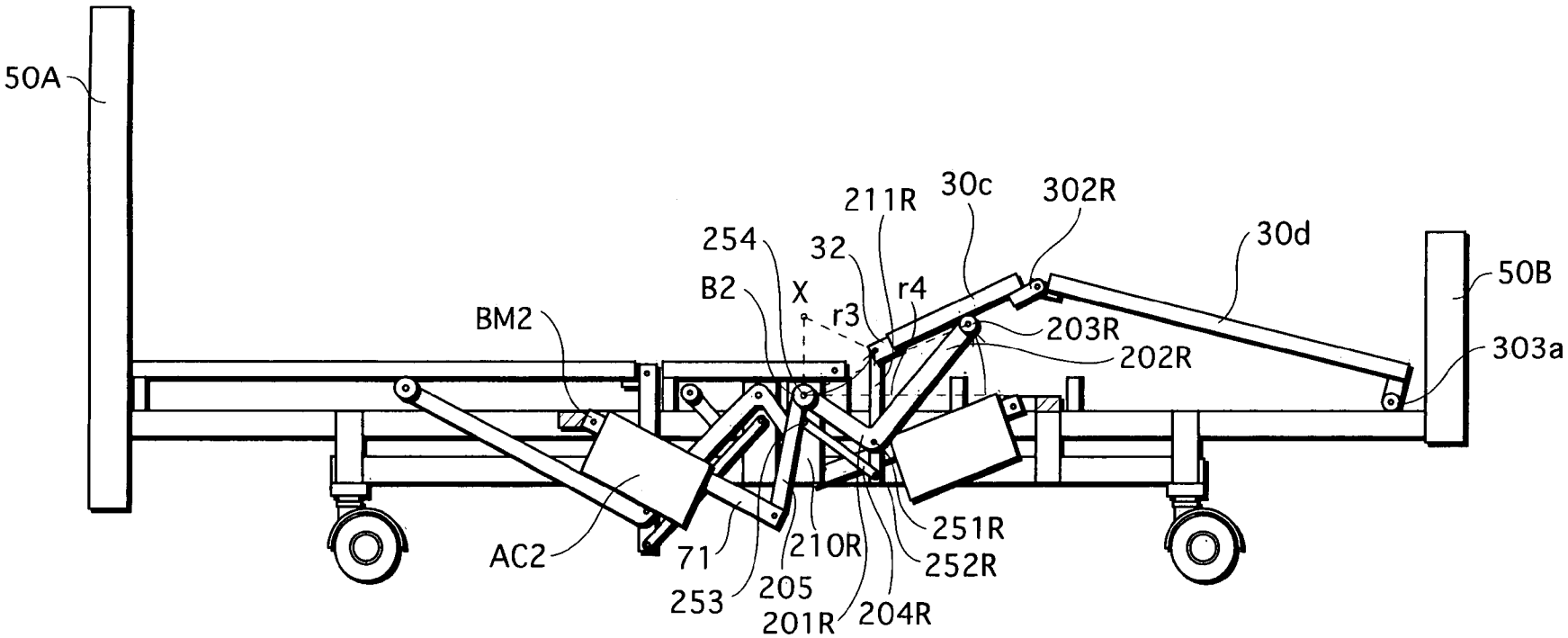
FIG. 6 schematically shows a state when the knee-break mechanism is operated.

Providing parallel link mechanism 25R having the pair of perpendicular arms 210R/211R and always keeping arms 210R/211R in a perpendicular position allows knee-break mechanism 10R to perform the knee-break action around an imaginary rotation center X located a prescribed distance from the surface of lower-back board 30*b*, based on the translational driving of parallel link mechanism 25R when the bed is operated (see FIG. 6). Imaginary rotation center X is provided so as to be near the motion center of the care recipient's body when the knee-break action is performed.

The effects of the knee-break mechanism are described in a later section.

Note that the structure of knee-break mechanism 20L is similar to knee-break mechanism 20R.

Because knee-break mechanisms 20R and 20L, as shown in FIG. 1, share bar B2, actuator AC2 and drive arm 205, the two mechanisms are driven simultaneously in the same manner when the action is performed.

1-4. Operation of Sitting-Up Mechanism

Adjustable bed 1 having the above structure is used with a mattress such as mattress 40 shown in FIG. 2 laid on coupled platform 30. Under general conditions as shown in FIG. 2, coupled platform 30 (30*a*–30*d*) is set to form a substantially horizontal surface.

When a user (caregiver in the given example) selects and executes an item relating to "sitting-up action" from a menu via a remote controller, firstly actuator AC1 attached to beam BM1 of second frame 3 operates to extend shaft 70. Due to the driving force of actuator AC1, drive arm 105 coupled to the tip of shaft 70 rotates on bar B1.

Parallel link mechanisms 15R/15L in sitting-up mechanisms 10R/10L are translationally driven by the rotation of bar B1. A schematic structure of sitting-up mechanism OR during the sitting-up action is shown in FIG. 5. The rotation of bar B1 elevates moving arm 101R fixed to bar B1 together with moving arm 104R, around pivotal coupling point 154R as the rotation center. Because of perpendicular arm 110R being fixed perpendicularly to frames 2 and 4, perpendicular arm 111R is elevated upward at this time, while maintaining a perpendicular position. Bar 31 coupled to the tip of perpendicular arm 111R is elevated around imaginary rotation center O located a prescribed distance above the surface of lower-back board 30*b*, in a circular motion whose radius is a distance r1 from imaginary rotation center O to pivotal coupling point 154R. The coupling of bar 31 to upper-back board 30*a* means that, ultimately, the bed-foot end of upper-back board 30*a* is elevated by this circular motion.

On the other hand, due to a circular motion whose radius is a linear distance r2 from pivotal coupling point 154R (i.e. rotation center of parallel link) to the tip of support arm 102R, roller 103R disposed at the tip of support arm 102R rolls down the underside of upper-back board 30*a* to provide support.

Furthermore, following the action of parallel link mechanism 15R, roller 107R at the tip of lifting arm 106R, which is provided on moving arm 101R, pushes the end of lower-back board 30*b* nearer to upper-back board 30*a* upward, so as to incline board 30*b* at a prescribed angle.

The above sitting-up action is performed simultaneously using sitting-up mechanisms 10R and 10L. Also, drive shaft 70 of actuator AC1 can be retracted to reverse this action.

With adjustable bed 1, this series of mechanisms results in the sitting-up action being performed by a circular motion around imaginary rotation center O located a prescribed distance above the surface of lower-back board 30*b*. The location of imaginary rotation center O near the motion center (e.g. a predetermined joint) of the care recipient's body when flexed, allows the sitting-up mechanism to operate in sympathy with the body's motion center. This prevents any slippage of the care recipient's body in relation to the surface of upper-back board 30*a* when the sitting-up action is performed, thereby suppressing the occurrence of bedsores and realizing a natural sitting-up action (i.e. postural change from lying to sitting position) that takes account of the care recipient's body movement.

A major feature of adjustable bed 1 of embodiment 1 is being able to increase the angle of upper-back board 30*a* with respect to the reference bed surface when the sitting-up action is performed, in proportion to the length of radius r2 (see FIG. 5).

Specifically, in order to incline upper-back board 30*a* more dynamically to perform the sitting-up action, either support arm 102R (and support arm 102L) or the pair of moving arms 101R/104R (and moving arms 101L/104L) lying in the longitudinal direction of the bed can be lengthened, thereby enabling the platform surface of coupled platform 30 in adjustable bed 30 to be maintained at a low height.

As a result, adjustable bed 1 of embodiment 1 has the merit of being usable as a so-called low platform bed having a low platform surface, since an excellent Gatch action is obtained without needing to provide a large-scale Gatch mechanism in a lower part of the bed as in the prior art (e.g. technology disclosed in Japanese Published Patent Application No. 2000-135146).

Adjustable bed 1 of embodiment 1 is thus able to lighten the workload on the caregiver, and be used as an extremely safe nursing care bed.

Note that by initially raising upper-back board 30*a* in the sitting-up action to a slightly larger angle (e.g. approx. +5 degrees) than target angle of inclination and then lowering board 30*a* back to the target angle, it may be possible to reduce any physical pressure felt the care recipient.

Furthermore, with adjustable bed 1 of embodiment 1, as shown in FIG. 5, upper-back board 30*a* and lower-back board 30*b* form a smoothly curved surface that allows the flexion action of the care recipient's body to be gently supported, because of roller 107R at the tip of lifting arm 106R, which is provided on moving arm 101R, pushing lower-back board 30*b* upward to incline board 30*b* at a prescribed angle. In addition to this, any sinking of the care recipient's lower-back position is effectively prevented by lower-back board 30*b* being pushed upward.

1-5. Operation of Knee-Break Mechanism

The knee-break action performed by adjustable bed 1 is similar to the sitting-up action in terms of the mechanism used.

Under general conditions as shown in FIG. 2, when a user (caregiver in the given example) selects and executes an item relating to "knee-break action" from a menu via a remote controller in a state in which coupled platform 30 (30*a*–30*d*) is set to be substantially horizontal, firstly actuator AC2 attached to beam BM2 of second frame 3 operates to extend shaft 71. Due to the driving force of actuator AC2, drive arm 205 coupled to the tip of shaft 71 rotates on bar B2.

Parallel link mechanisms 25R/25L in knee-break mechanisms 20R/20L are translationally driven by the rotation of bar B2. A schematic structure of knee-break mechanism 20R during the knee-break action is shown in FIG. 6. The rotation of bar B2 elevates moving arm 201R fixed to bar B2 together with moving arm 204R, around pivotal coupling point 254R as the rotation center. Because of perpendicular arm 210R being fixed perpendicularly to frames 2 and 4, perpendicular arm 211R is elevated upward at this time, while maintaining a perpendicular position. Bar 32 coupled to the tip of perpendicular arm 211R is thus elevated around imaginary rotation center X located a prescribed distance above the surface of lower-back board 30*b*, in a circular motion whose radius is a distance r3 from imaginary rotation center X to pivotal coupling point 254R. The coupling of bar 32 to upper-leg board 30*c* means that, ultimately, the bed-head end of upper-leg board 30*c* is elevated by this circular motion.

On the other hand, due to a circular motion whose radius is a linear distance r4 from pivotal coupling point 254R (i.e. rotation center of parallel link) to the tip of support arm 202R, roller 203R disposed at the tip of support arm 202R rolls down the underside of upper-leg board 30*c* to provide support. Lower-leg board 30*d* coupled to upper-leg board 30*c* is elevated upward at this time, inclining upper-leg board 30*c* and lower-leg board 30*d* at a prescribed angle.

The above knee-break action is performed simultaneously using both knee-break mechanisms 20R and 20L. Also, drive shaft 71 of actuator AC2 can be retracted to reverse this action.

With adjustable bed 1, this series of mechanisms results in the knee-break action being performed by a circular motion around imaginary rotation center X located a prescribed distance above the surface of lower-back board 30*b*. The location of imaginary rotation center X near the motion center (e.g. a predetermined joint) of the care recipient's body when flexed, allows the knee-break mechanism to move in sympathy with the body's motion center. This prevents any slippage of the care recipient's body in relation to the surface of upper-leg board 30*c* when the knee-break action is performed, thereby suppressing the occurrence of bedsores and realizing a natural knee-break action (i.e. postural change from lying to knee-break position) that takes account of the care recipient's body movement.

A feature of adjustable bed 1 is being able, using knee-break mechanisms 20R/20L, to increase the angle of upper-leg board 30*c* with respect to the reference bed surface when the knee-break action is performed, in proportion to the length of radius r4, as was the case with sitting-up mechanisms 10R/10L. In order to incline upper-leg board 30*c* and lower-leg board 30*d* more dynamically to perform the knee-break action, either support arm 202R (and support arm 202L) or the pair of moving arms 201R/204R (and moving arms 201L/204L) lying in the longitudinal direction of the bed can be lengthened, thereby enabling the platform surface of coupled platform 30 in adjustable bed 30 to be maintained at a low height. Adjustable bed 1 is thus able to exhibit the merit of being usable as a low platform bed, which lightens the caregiver's workload and makes for an extremely safe nursing care bed.

1-6. Driving of Sitting-Up and Knee-Break Mechanisms

While the sitting-up and knee-break mechanisms are described separately above in order describe each mechanism in detail, these mechanisms (sitting-up, knee-break) may of course be operated at the same time according to embodiment 1.

FIG. 7 shows the structure of adjustable bed 1 directly after the sitting-up and knee-break actions have been performed. The independent driving of actuators AC1 and AC2 means that they can be made to operate at the same time by setting the motor driver and microcomputer. Note that sitting-up mechanisms 10R/10L having actuator AC1 and knee-break mechanisms 20R/20L having actuator AC2 may be driven either simultaneously, or sequentially with a slight time lag therebetween (e.g. performing the knee-break following the sitting-up action).

1-7. Related Matters

While the example shown in embodiment 1 uses direct-acting actuators, actuators, such as rotational actuators, employing other drive methods may be used. Other drive sources may also be used, examples of which include air or hydraulic powered actuators.

While parallel link mechanisms 15R/15L having perpendicular arms 110R(L)/111R(L) are provided in the example given in embodiment 1, perpendicular arms 110R(L)/111R(L) are not restricted to being disposed perpendicularly. As long as perpendicular arms 110R(L)/111R(L) are disposed so as to at least intersect the reference bed surface (horizontal bed surface) under general conditions, upper-back board 30*a* can be dynamically inclined to perform the sitting-up action, while keeping the platform surface at a low height. A similar modification can also be applied to parallel link mechanisms 25R(L) having perpendicular arms 210R(L)/211R(L).

Embodiment 2

2-1. Overall Structure of Adjustable Bed

Figure 8:
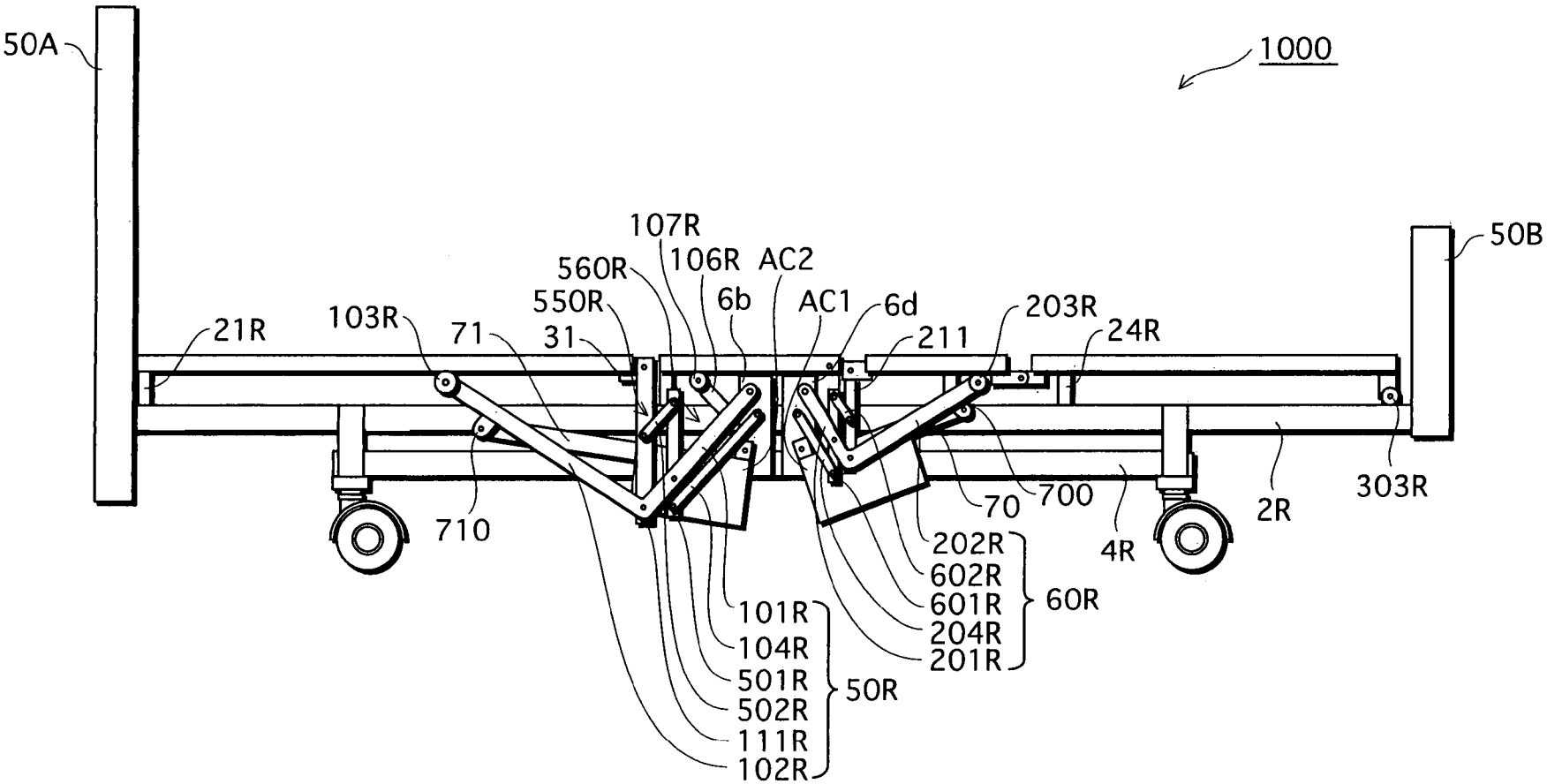
FIG. 8 is a side view showing a structure of an adjustable bed 1000 of an embodiment 2.
Figure 9:
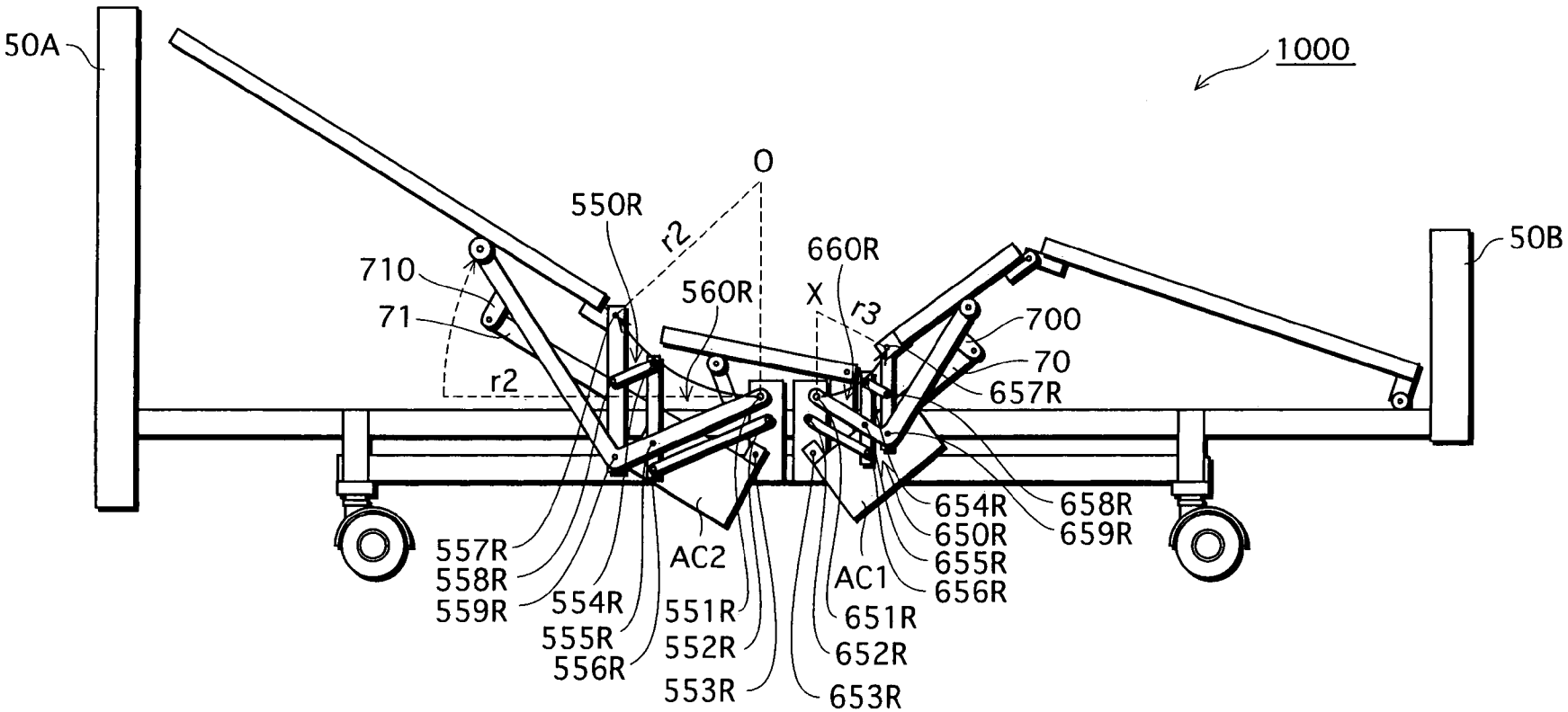
FIG. 9 is a side view showing a structure of adjustable bed 1000 when driven.

FIG. 8 is a side view showing the systematic structure of an adjustable bed 1000 pertaining to embodiment 2. FIG. 9 is an operation diagram of adjustable bed 1000. Plates 6*a* and 6*c* etc have been omitted here in order to simplify the internal structure of adjustable bed 1000.

As shown in FIG. 8, adjustable bed 1000 differs from adjustable bed 1 by virtue of the fact that parallel link mechanisms 50R/50L and 60R/60L (50L and 60L not depicted) equating to parallel link mechanisms 15R/15L and 25R/25L, also include pantograph mechanisms that provide extendibility in the longitudinal direction of the bed.

Specifically, as shown in FIG. 8, parallel link mechanism 50R is formed from the combination of three perpendicular arms 6*b* (plate fixed to frame 2), 501R and 111R constituting one group, and three moving arms 502R, 101R and 104R constituting another group.

Of these, perpendicular arms 6*b*/501R and moving arms 101R/104R are axially supported by pivotal coupling points 551R, 552R, 555R and 556R, while moving arms 101R/502R and perpendicular arms 501R/111R are axially supported by pivotal coupling points 554R, 555R, 558R and 559R. A first parallel link mechanism 560R constituted from perpendicular arms 6*b*/501R and moving arms 101R/104R, and a second parallel link mechanism 550R constituted from moving arms 101R/502R and perpendicular arms 501R/111R are formed within parallel link mechanism 50R as a result, culminating in the overall formation of a pantograph mechanism extendable in the longitudinal direction toward the head end of the bed. The driving of pantograph mechanism is, as shown in FIG. 8, realized by driving actuator AC2, due to the coupling of actuator AC2 rotationally suspended from perpendicular arm 6*b* to support arm 102R connected to a tip 710 of shaft 71 thereof.

Parallel link mechanism 60R having substantially the same structure as parallel link mechanism 50R, is also formed from the combination of three perpendicular arms 6*d* (plate fixed to frame 2), 601R and 211R constituting one group, and three moving arms 602R, 201R and 204R constituting another group.

Perpendicular arms 6*d*/601R and moving arms 201R/204R are axially supported by pivotal coupling points 651R, 652R, 655R and 656R, while moving arms 201R/602R and perpendicular arms 601R/211R are axially supported by pivotal coupling points 654R, 655R, 658R and 659R. A first parallel link mechanism 660R constituted from perpendicular arms 6*d*/601R and moving arms 201R/204R, and a second parallel link mechanism 650R constituted from moving arms 201R/602R and perpendicular arms 601R/211R are formed within parallel link mechanism 60R as a result, culminating in the overall formation of a pantograph mechanism extendable in the longitudinal direction toward the foot end of the bed. The driving of pantograph mechanism is, as shown in FIG. 8, realized by driving actuator AC1, due to the coupling of actuator AC1 rotationally suspended from perpendicular arm 6*d* to support arm 202R connected to a tip 700 of shaft 70 thereof.

Parallel link mechanisms 50R/50L (60R/60L) have similar structures, and are driven by actuator AC2 (AC1).

2-2. Effects of Adjustable Bed

Adjustable bed 1000 of embodiment 2 exhibits substantially the same effects embodiment 1, as a result of the translational driving of parallel link mechanisms 50R and 60R (50L, 60L) disposed respectively toward the head and foot ends of the bed when the bed is driven, this being achieved by driving parallel link mechanisms 50R and 60R (50L, 60L) using actuators AC2 and AC1 located directly below the mechanisms.

An additional feature of embodiment 2 is the compact disposal of parallel link mechanisms 50R and 60R (50L, 60L) toward the head and foot ends of the bed, respectively. In other words, because parallel link mechanisms 50R and 60R (50L, 60L) are each formed as a pantograph mechanism constituted from two parallel link mechanisms, the use of pantograph mechanisms allows the link mechanisms in a bed configuration under general conditions to fold down to an even smaller size than embodiment 1.

The effect of using these pantograph mechanisms is particularly demonstrated by the fact because the tip of moving arm 104R(L) at the bed-head end and the tip of moving arm 204R(L) at the bed-foot end are coupled to perpendicular arms 501R(L) and 601R(L), the length of various members is suppressed in comparison with a structure such as adjustable bed 1, in which moving arms 104R(L) and 204R(L) are coupled to perpendicular arms 111R(L) and 211R(L) located respectively toward the head and foot ends of the bed.

In other words, with adjustable bed 1000 an even lower bed platform can be realized, because of being able to minimize the size of parallel link mechanisms 50R and 60R (50L, 60L) in the height direction of the bed. By thus being able to lower the platform height, the work efficiency of the caregiver (e.g. when helping a care recipient up onto or down from the bed) is dramatically improved, in addition to reducing any mental anxiety to the care recipient when the bed is driven.

Furthermore, with adjustable bed 1000, being able to shorten the moving arms and perpendicular arms in the link mechanisms in comparison with adjustable bed 1, as a result of the compacting of parallel link mechanisms 50R and 60R (50L, 60L), reduces the mechanical flexure and improves the stiffness/strength of the various members accordingly, thereby enabling safe driving.

The high stiffness and stable driving of adjustable bed 1000 obtained in comparison with adjustable bed 1 is due also to actuators AC1 and AC2 being structured to push up support arms 102R(L) and 202R(L) directly (i.e. drive arms 105/205 in adjustable bed 1 not necessary).

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An adjustable bed comprising a platform having a first surface member and a second surface member disposed adjacently in a longitudinal direction of the bed, and a Gatch mechanism for performing a Gatch action to raise a platform surface of the first surface member from a reference bed surface, wherein the Gatch mechanism includes a parallel link mechanism formed from a first arm group that lies in the longitudinal direction of the bed and a second arm group disposed at an angle intersecting the reference bed surface, with the first surface member being coupled to the second arm group by a coupling part, and as a result of the second arm group, when the Gatch action is performed, being translationally driven while maintaining the angle intersecting the reference bed surface, the Gatch mechanism raises the platform surface of the first surface member from the reference bed surface due to a circular motion of the coupling part around an imaginary rotation center located at a prescribed height above the second surface member.

2. The adjustable bed of claim 1, wherein the first and second arm groups each include three or more arms, as a result of which is formed a pantograph mechanism extendable in the longitudinal direction of the bed.

3. The adjustable bed of claim 1, wherein a support arm lying in the longitudinal direction of the bed is fixed to the first arm group at a prescribed angle, and the Gatch action involves the support arm rising up together with the translational action of the second arm group, with a coupling point of the first and second arm groups as a rotation center, and pushing the first surface member up from below.

4. The adjustable bed of claim 1, wherein the platform includes at least one of (a) an upper-back platform and a lower-back platform, and (b) the lower-back platform and an upper-leg platform, and a combination of the first and second surface members equates to at least one of (a) the upper-back and lower-back platforms in the same order, and (b) the upper-leg and lower-back platforms in the same order.

5. The adjustable bed of claim 4, wherein the platform further includes a lower-leg platform that is moveably coupled to the upper-leg platform, and the lower-leg platform inclines together with the upper-leg platform being raised from the reference bed surface when the Gatch mechanism is driven.

6. The adjustable bed of claim 1 further comprising a mechanism that is interlocked with the Gatch mechanism, and elevates the end of the second surface member nearer the first surface member to a position higher than the reference bed surface when the Gatch mechanism is driven.

7. A mattress for use with the adjustable bed of claim 1, comprising a plurality of mattress sections disposed in a longitudinal direction of the bed, wherein each section in at least one pair of adjacent mattress sections includes a protrusion that fit together in a thickness direction of the bed, and an overall length of the mattress extends when the Gatch action is performed, due to the complementary protrusions shifting apart in the longitudinal direction of the bed.

* * * * *